US007032402B2

(12) United States Patent
Braswell

(10) Patent No.: US 7,032,402 B2
(45) Date of Patent: Apr. 25, 2006

(54) WEATHER GUARD APPARATUS FOR AIR CONDITIONING UNITS

(76) Inventor: Paul Randall Braswell, 1763 County Rd. 1159, Brashear, TX (US) 75240

( * ) Notice: Subject to any disclaimer, the term of this patent is extended or adjusted under 35 U.S.C. 154(b) by 0 days.

(21) Appl. No.: 10/944,567

(22) Filed: Sep. 17, 2004

(65) Prior Publication Data

US 2006/0059935 A1 Mar. 23, 2006

(51) Int. Cl.
*F25B 39/04* (2006.01)

(52) U.S. Cl. ..... 62/259.1; 62/507; 52/23

(58) Field of Classification Search ..... 52/3, 52/23, 71, 73, 74; 62/259.1, 507
See application file for complete search history.

(56) References Cited

U.S. PATENT DOCUMENTS

| | | | | |
|---|---|---|---|---|
| 2,705,990 | A | 4/1955 | Miller | |
| 2,892,424 | A | 6/1959 | Mondi | |
| 2,901,989 | A | 9/1959 | Mondi | |
| 2,941,380 | A | 6/1960 | Garred | |
| 3,379,481 | A | 4/1968 | Fisher | |
| 4,730,423 | A * | 3/1988 | Hughes | 62/259.1 |
| 4,768,350 | A | 9/1988 | Moran, Jr. | |
| 6,158,175 | A * | 12/2000 | Carter | 52/71 |
| 6,430,954 | B1 * | 8/2002 | Smith | 62/259.1 |
| 6,595,017 | B1 | 7/2003 | Teahan | |
| 2003/0177703 | A1 | 9/2003 | Forbis | |
| 2003/0226369 | A1 | 12/2003 | Comanescu | |

* cited by examiner

*Primary Examiner*—Harry B. Tanner
(74) *Attorney, Agent, or Firm*—Cash Klemchuk Powers Taylor LLP; Darin M. Klemchuk

(57) ABSTRACT

A system for protecting air-conditioning units from damage caused by hail and other inclement weather conditions is described. The system includes one or more protective panels, each having a frame and a protective screen. The panels are attached to the housing of an air-conditioning unit using a variety of brackets and clamps. The system protects air-conditioning units without significantly restricting the air flow around the units and additionally shades the units to enhance their performance by lowering their temperature.

20 Claims, 4 Drawing Sheets

WEATHER GUARD APPARATUS FOR AIR CONDITIONING UNITS

BACKGROUND

The present invention relates generally to protective housing for air-conditioning units and heat pumps, and in particular to a protective unit capable of protecting exposed, including rooftop, air-conditioning units from hail and other inclement weather damage while being easy to assemble and disassemble.

Outdoor air-conditioning units typically include a compressor, a condenser, a grill, various piping and valves, and a fan all contained within a metal housing. The purpose of an air-conditioning unit is to transfer the heat from a building or structure to refrigerant in the air-condition system piping, and then transmit this heat to the ambient environment outside of the building or structure.

In commercial applications, the units are commonly located on the rooftop of a building. As a result, the air-conditioning unit may be exposed to direct sunlight as well as hail and other inclement weather conditions. Hail poses a particular hazard to air-conditioning units because hail striking the grill of a unit can deform the thin metallic fins that compose the grill. This results in lowered air-conditioning efficiency of the unit. To correct a grill damaged by hail, a repairman will frequently attempt to straighten the fins that were bent or otherwise deformed by the hail.

Rooftop exposure to sunlight can also increase the temperature of an air-conditioning unit and its internal components. This can reduce the heat-transfer rate from the air-conditioning unit, and significantly impact the air-conditioning unit's efficiency. Exposure to sunlight can also lead to increased head pressures within the unit potentially resulting in the unit shutting it down or failing.

Periodically, air-conditioning units must be serviced. This often requires access to the grills of the unit and the upper surface of the unit, typically where the compressor fan discharges hot air.

Protective hoods for room-type air-conditioning units are known in the art. U.S. Pat. Nos. 2,705,990; 2,892,242; 2,901,989; and 2,941,380 are examples of apparatus and systems for protecting air-conditioning units installed in windows. However, none of the inventions of these patents provide an apparatus that can collectively guard rooftop air-conditioning units against hail, provide protection from sunlight, and can be quickly and easily assembled and disassembled. For example, U.S. Pat. No. 2,705,990 discloses a "ventilated tarpaulin" that fits snugly over the exposed areas of a window-sill installed air conditioner. This apparatus is insufficient to guard against hail because it does not provide a rigid barrier around the grills of the air conditioning unit to deflect hail.

Solar shades or sun shrouds known in the art, such as those disclosed in U.S. Pat. Nos. 4,768,350 and 6,595,017 and U.S. patent application Ser. Nos. 10/393,619 (U.S. 2003/0177703 A1) and 10/064,090 (U.S. 2003/0226369 A1), also do not address these needs because the solar shades are either not constructed of sufficiently sturdy material, are not sufficiently securely attached to the air-conditioning units to withstand hail, or are not easily assembled and dissembled.

A need exists, therefore, for apparatus capable of guarding exposed air-conditioning units from hail and other inclement weather conditions that is capable of being quickly and easily assembled and disassembled to facilitate servicing of the units. A need also exists for apparatus that can provide solar shade to rooftop air-conditioning units that also can resist hail strike and other inclement weather conditions.

All references cited herein are incorporated by reference to the maximum extent allowable by law. To the extent a reference may not be fully incorporated herein, it is incorporated by reference for background purposes and indicative of the knowledge of one of ordinary skill in the art.

SUMMARY

The present invention is directed to a system and apparatus that satisfies these needs. The apparatus of the present invention comprises one or more protective panels 220. Each protective panel 220 is made of a frame 222 and a protective screen 224. The screen is preferably made of non-metallic breathable material. One or more protective panels 220 are securely attached to the upper portion of the housing 102 of the air-conditioning unit 100. The lower portion of the protective panels 220 are supported by one or more support rods 230, which are securely attached to the lower portion of the housing 102 of the air-conditioning unit 100.

In another embodiment of the present invention, the upper portion of the protective panel 220 is rotatably secured to the upper housing 102 of the air-conditioning unit 100 such that the angle of the panel 220 relative to the vertical surface of the housing 102 may be adjusted before the panel 220 is securely fastened. This allows a user to optimize the degree of protection from hail based on the weather conditions in the particular geographic area in which the weather guard 200 is installed.

In another embodiment of the invention, the lower portion of the frames 222 of the protective panels 220 supported by support rods 230 are secured by clamps 244, which can be easily removed. This allows a user to quickly and easily lower the protective panel 220 to facilitate repair or servicing of the air-conditioning unit 100.

In another embodiment of the present invention, the screen 224 of the protective panel 220 is comprised of solar screen material capable of deflecting the sun's rays, thereby shading and lowering the temperature of the air-conditioning unit 100.

In another embodiment of the present invention, the screen 224 of the protective panel 222 is pillow shaped and accepts the frame 222 of the protective panel 220 inside the cavity of the screen 224. The screen 224 also has a flap that facilitates installing and removing the frame 222.

In another embodiment of the present invention, a triangular protective panel 260 is included and installed between two adjacent protective panels 220 to further enhance protection from hail.

Other objects, features, and advantages of the present invention will become apparent with reference to the drawings and detailed description that follow.

DESCRIPTION

In the following detailed description of the preferred embodiments, reference is made to the accompanying drawings, which form a part hereof, and in which is shown by way of illustration specific preferred embodiments in which the invention may be practiced. These embodiments are described in sufficient detail to enable those skilled in the art to practice the invention, and it is understood that other embodiments may be utilized and that logical changes may be made without departing from the spirit or scope of the invention. To avoid detail not necessary to enable those skilled in the art to practice the invention, the description may omit certain information known to those skilled in the art. The following detailed description is, therefore, not to be taken in a limiting sense, and the scope of the present invention is defined only by the appended claims.

Figure 1:
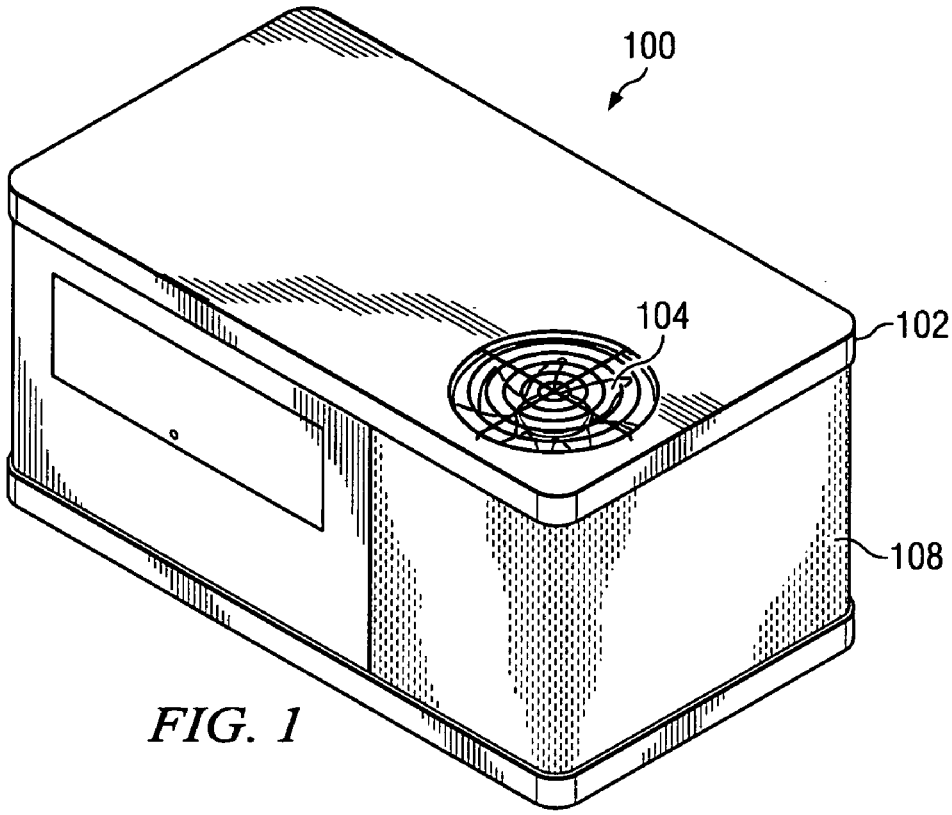
FIG. 1 is a perspective view illustrating a typical rooftop air-conditioning unit 100.

FIG. 1 illustrates a typical rooftop air-conditioning unit 100 having housing 102, condenser fan 104, grill 106, and fins 108. The weather guard 200 includes one or more protective panels 220. In the preferred embodiment, every side of the air-conditioning unit 100 having a condenser grill 106 is protected by the weather guard 200. For example, in FIG. 2, only two sides of air-conditioning unit 100 have compressor grills 106. Therefore, two protective panels 220 and an optional triangular protective panel 260 are installed on the sides of the air-conditioning unit 100 having condenser grills 106. The triangular protective panel 106 is not required by the invention, but its inclusion enhances performance by providing additional protection from hail, which otherwise would not be stopped by the rectangular protective panels 220.

Figure 4:
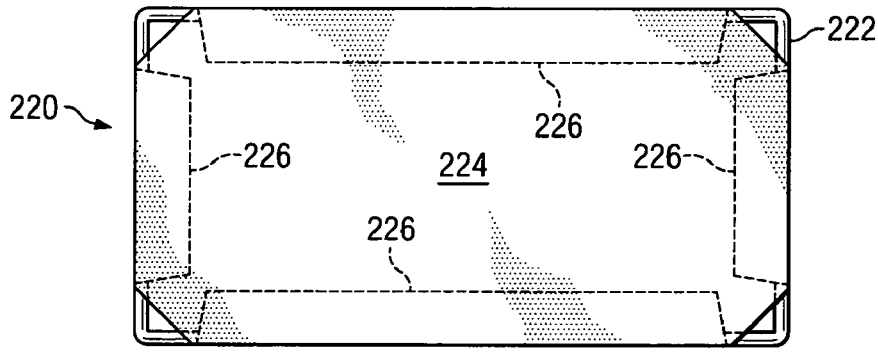
FIG. 4 is a top view of the present invention illustrating panel 220 of the weather guard 200.
Figure 5:
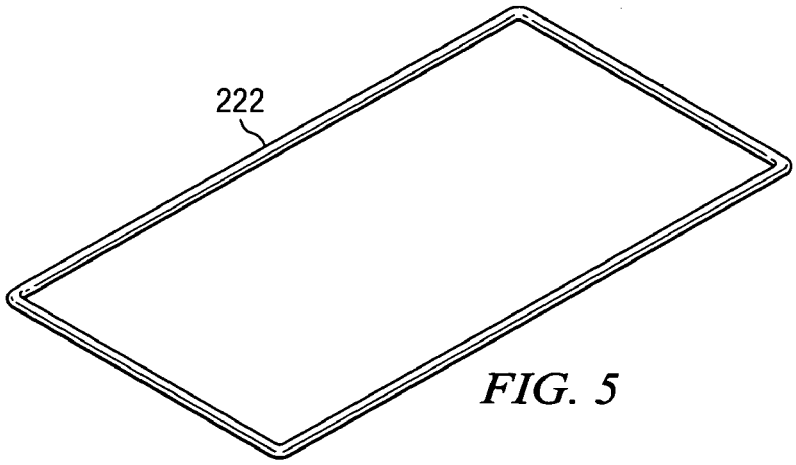
FIG. 5 is a perspective view of the present invention illustrating frame 222 of panel 220.
Figure 6:
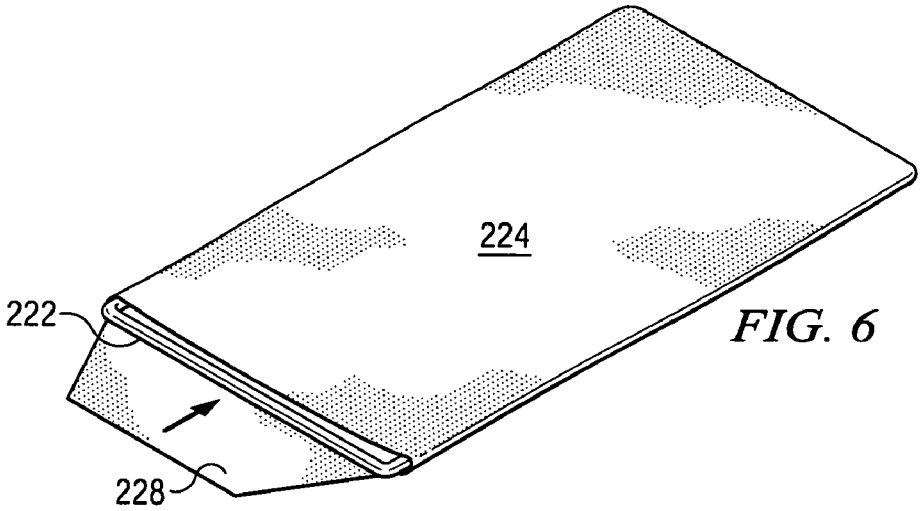
FIG. 6 is a perspective view of the present invention illustrating protective screen 224 and flap 228 of panel 220.

FIGS. 4 through 6 illustrate the protective panel 220 and its components. Protective panel 220 is composed of a frame 222 and a protective screen 224. Although copper is preferred, the frame 222 may be constructed of cvc, piping, wood, steel, aluminum, plastic, or some other rigid material. The material must be of sufficient rigidity to withstand hail striking the unit without it breaking. It should additionally be appreciated that the frame 222 may formed of any suitable shape and size. In the preferred embodiment shown in FIG. 2, the frame 222 is rectangular or square in shape, depending on the shape of the air-conditioning unit 100 sides. The frame 222 is preferably sized so that substantially one side of the air-conditioning unit 100 is shielded by the protective panel 220.

Protective screen 224 is made of nylon mesh and the like breathable material. Preferably, the material is not made of metal because metal will retain heat from the sun causing the air-conditioning unit's temperature and possibly its head pressure to increase, thereby reducing its performance. In the preferred embodiment, the material is made of at least 90-degree highly solar deflective shading mesh or includes a layer of solar material attached to nylon mesh. This type of material is disclosed in U.S. Pat. No. 6,595,017 (column 3). However, the material selected must be sufficient sturdy to deflect hail striking the panel.

However, unlike the solar shade disclosed in U.S. Pat. No. 6,595,017, the protective screen 224 cannot be attached to the frame through the use of double-sided tape, epoxy, or rubber strips. Rather, it must be fastened sufficiently secure to resist hail striking the protective screen 224. In one embodiment, the protective panel 220 is constructed by placing the frame 222 on top of the protective screen 224. The protective screen 224 should be larger than the frame 222 such that material of the protective screen 224 is folded over the frame 222 forming flaps 226 as shown in FIG. 4 in phantom lines. The flaps 226 are then secured, preferably by double stitching, to the material of the protective screen 224 on the opposite side of the frame 222.

In the preferred embodiment shown in FIG. 6, the protective screen 224 is made of a shape substantially similar to a pillowcase and has one flap 228 near the opening of the screen. The protective panel 220 is constructed by inserting framing 222 into the opening of the screen 224 (and cavity therein) and securing the flap 228 to the screen 224 once the frame 222 is fully inserted. Preferably, the flap 228 is releasably secured using Velcro® or some other means. One skilled in the art would appreciate the multitude of different manners in which this may be accomplished including double stitching the flap 228 to the screen 224, or using snaps, buttons, and the like. Velcro® is preferred because it provides a quick and easy method of removing and installing a new protective screen 224 in the event one is damaged by hail or worn out by the elements.

In the preferred embodiment, the protective screen 224 is shaped such that is not completely taut on the frame 222. Some degree of slackness in the protective screen 224 allows it to perform substantially like a trampoline when hail strikes it. This provides an enhanced deflection of the hail while preserving the life of the protective screen 224. However, a taut protective screen 224 may be used according to the present invention, but generally will not perform as well.

Figure 2:
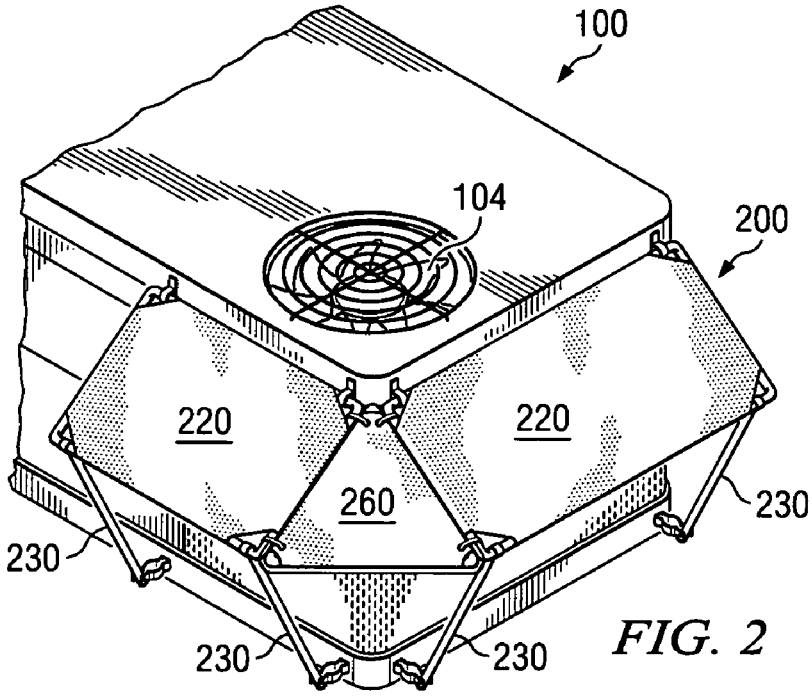
FIG. 2 is a perspective view of the present invention illustrating the weather guard unit 200 installed onto a rooftop air-conditioning unit 100.

Turning to FIG. 2, the weather guard 200 is shown in its installed position. The protective panels 220 are installed generally by attaching them to the top of the housing 102 of the air-conditioning unit 100. The protective panels 220 are supported on their lower ends by support rods 230, which are secured to the lower portion of the housing 102 of the air-conditioning unit 100.

In the preferred embodiment, the upper portion of the protective panel 220 is rotatably attached to the housing 102 of the air-conditioning unit 100. This allows a user to alter the angle of the protective panel 220 relative to the condenser grill 106 of the air-conditioning unit 100. Generally, an angle of 45 degrees is preferred, but this angle may need to be modified according to the characteristics of hailstorms in the particular geographic area in which the unit is installed. Using a protective panel 220 with a height equal to or greater than two thirds the height of the air-conditioning unit 100 has been found to provide optimal protection from hail and shading of the air-conditioning unit 100. Also, support rods 230 of different length or adjustable length may be used to enhance the optimization of the angle at which the protective panels 220 are oriented.

Figure 7:
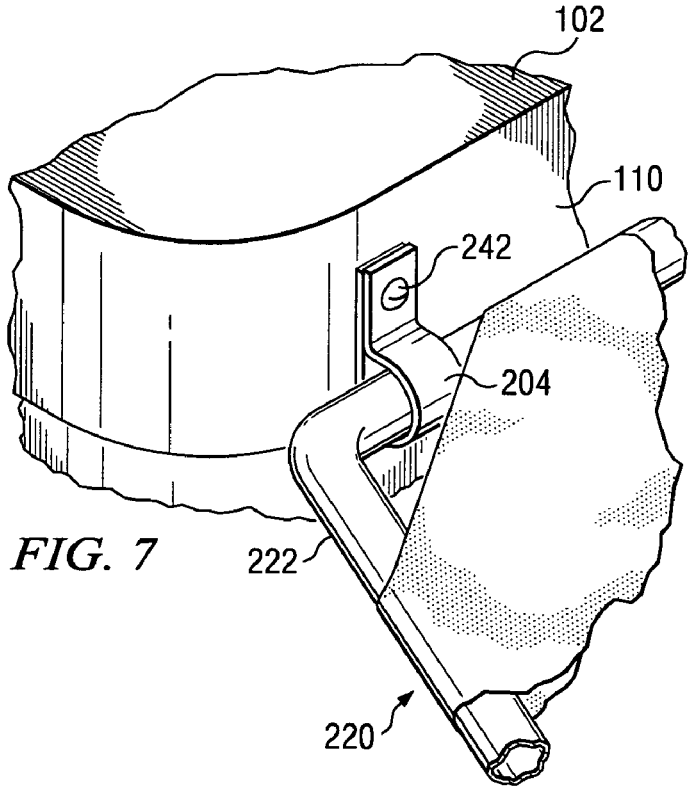
FIG. 7 is perspective view of the present invention illustrating one means of installing a panel 220 to the top of air-conditioning unit 100.

Turning to FIG. 7, the protective panel 220 is secured to the upper housing 102 of the air-conditioning unit 100 by a p-clamp 204 and a fastener 242. Preferably, two clamps are used to secure each end of the protective panel 220. In the preferred embodiment, the p-clamp 204 and fastener 242 are attached to an upper housing 110 of the air-conditioning unit. This location is preferred, among other reasons, because air-conditioning units often have pre-existing holes in their upper housing such that a user need not drill a hole into the unit to install the protective panel 220. Before tightening the fasteners 242, the user should adjust the protective panels 220 to the desired angle.

Figure 8:
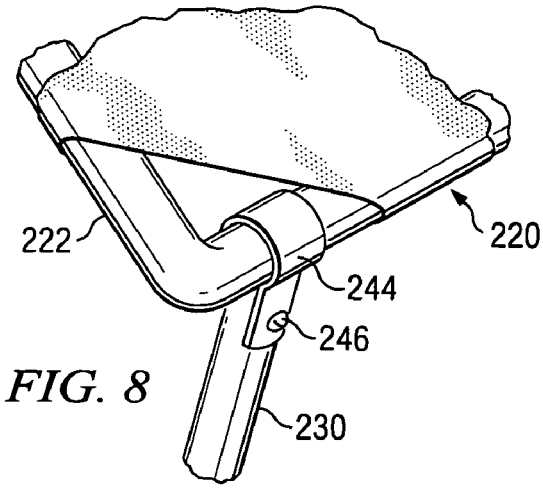
FIG. 8 is a perspective view of the present invention illustrating one means of installing the support rod 230 to panel 220.
Figure 9:
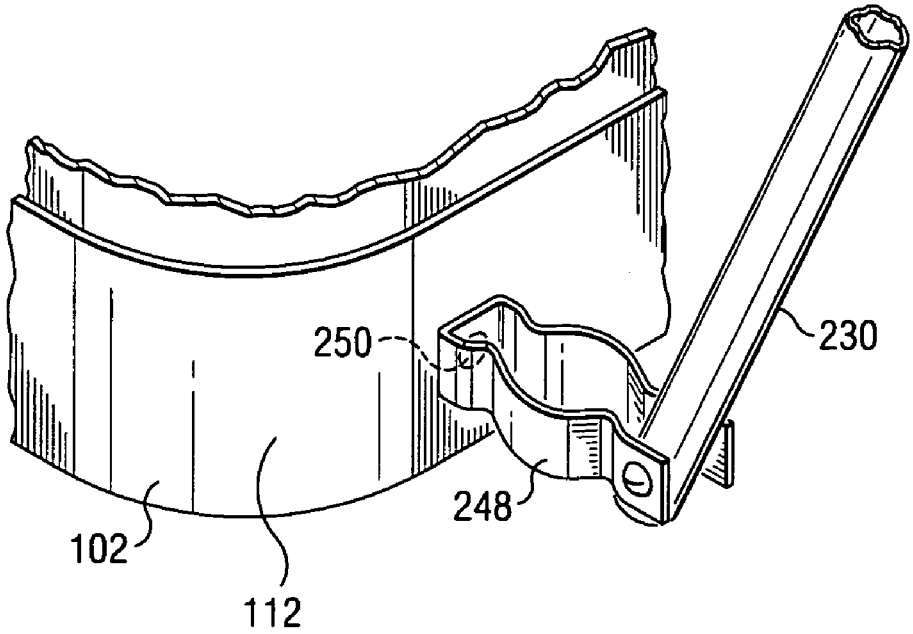
FIG. 9 is perspective view of the present invention illustrating one means of installing a panel supported by support rod 230 to the bottom of the air-conditioning unit 100.

FIG. 8 illustrates the attachment of support rod 230 to the lower portion of the frame 222 of the protective panel 220. The support rod 230 is secured by clamp 244 and fastener 246. In the preferred embodiment, two support rods 230 (as shown in FIG. 2) are used to support each protective panel 220. One or more rods 230 may be used to support the protective panels 220. The opposite end of the support rods 230 are secured to the lower portion 112 of the housing 102 of the air conditioning unit 100 through another clamp 248 and a fastener 250. Preferably, the drip railing (not shown) is the portion of the air-conditioning unit to which the support rods 230 are secured. FIG. 9 illustrates the installation of the support rod 230 to the air-conditioning unit 102. While a variety of clamps and brackets may be used, an electrical conduit standoff is preferred. As with upper portion of the protective panel, the lower end of each support rod 230 is preferably rotatably attached to the clamp 248 so that the angle of the support rod 230 and hence the position of the support panel 220 may be adjusted to suit a user's desires.

Figure 3:
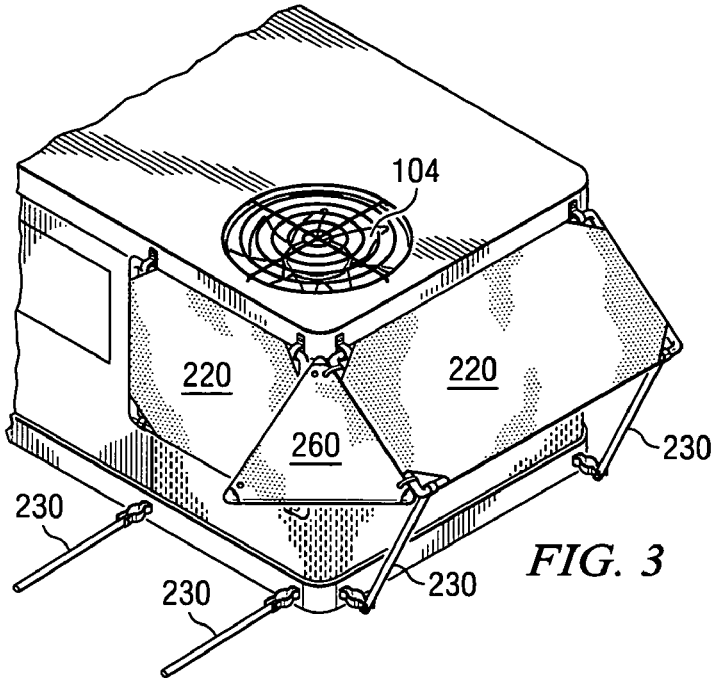
FIG. 3 is a perspective view of the present invention illustrating one panel 220 of the weather guard 200 in the lowered position.

As shown in FIG. 3, a protective panel 220 can easily be lowered by removing the support rods 230. This causes the protective panel 220 to hang substantially flush to the surface of the side of the air-conditioning unit 100. This allows a repairman greater access to the air-conditioning unit 100 to repair or service it.

As shown in FIG. 2, a triangular protective panel 260 may also be installed. In the preferred embodiment (illustrated in FIG. 10), the triangular protective panel 260 includes a frame 262 and protective screen 264 and is constructed similar to the protective panel 220. The frame 262 and protective screen 262 can be constructed of the same materials used to construct the frame 222 and protective screen 224 of the protective panel 220. Holes 266 are also included to facilitate attachment of the triangular protective panel 260 to the protective panels 220. A metal or rubber grommet (not shown) may be included with each hole to enhance its performance.

Figure 10:
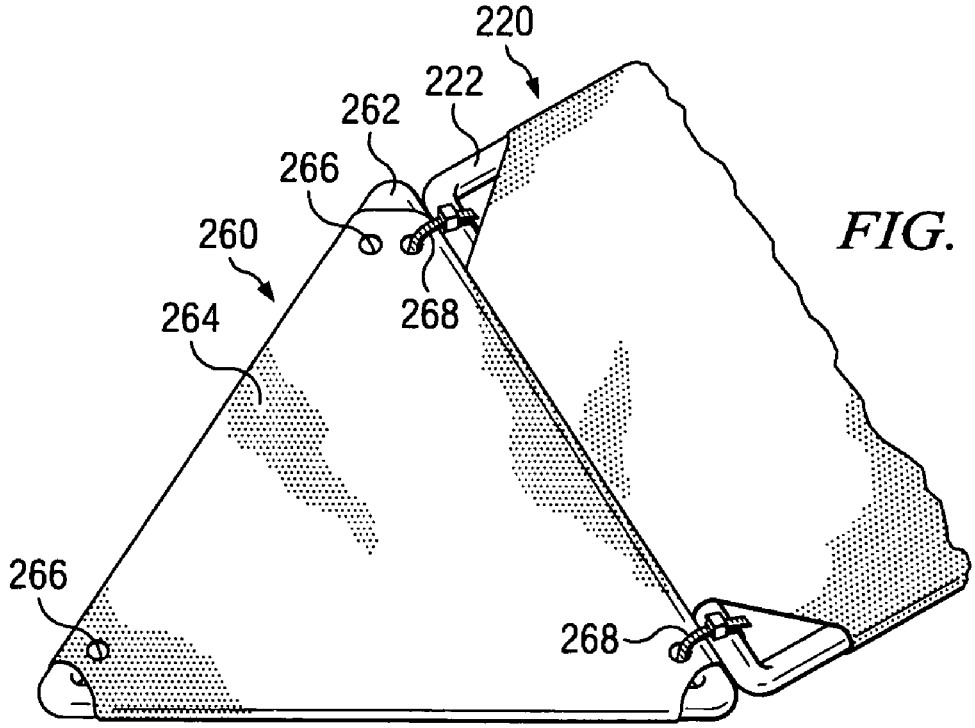
FIG. 10 is a perspective view of the present invention illustrating one method of installing a triangular panel 260 to panel 220 of the weather guard 200.

As shown in FIG. 10, commonly available tie wraps 268 are used to secure the frame of the triangular protective screen 260 and the protective screen 220. One end of the tie wrap 268 is inserted into the hole 266 and the other end of the tie wrap 268 is wrapped around the frame 222 of the protective panel 220. The tie wrap 268 is then pulled taut causing the triangular protective panel 260 to be secured to the protective panel 220. The other side of the triangular protective panel 260 can be installed in a similar manner to the other protective panel 220 (not shown).

The primary advantage of the present invention is that it provides a relatively easy to install and relatively inexpensive apparatus for protecting air-conditioning units from damage caused by hail and other inclement weather conditions. Another advantage of the present invention is that the weather guard 200 may be quickly and easily adjusted to accommodate a variety of angles relative to the surface of the air-conditioning unit 100 to optimize protection in a variety of different geographic locations. Another advantage of the present invention is that it does not restrict airflow in and out of the air-conditioning unit. Yet another advantage of the preferred embodiment of the present invention is that it is constructed of non-metallic solar shade material, which in addition to protecting air-conditioning units from hail damage, shades the unit thereby lowering its temperature and enhancing performance.

The system and apparatus for protecting an air-conditioning unit described herein is relatively easy to install, relatively inexpensive, does not significantly resist air flow into or out of the air-conditioning unit, is adjustable, and attaches directly to the air-conditioning unit housing.

While the invention has been described with reference to a preferred embodiment, it will be understood by those skilled in the art that various changes may be made and equivalents may be substituted for elements thereof without departing from the scope of the invention. In addition, many modifications may be made to the invention to adapt it to a particular situation without departing from the essential scope thereof. Therefore, it is intended that the invention not be limited to the particular embodiment disclosed as the best mode contemplated for carrying out this invention, but that the invention will include all embodiments falling within the scope of the appended claims.

I claim:

1. An apparatus for protecting an exposed air-conditioning unit comprising:

(a) at least one protective panel having a frame and a protective screen made of non-metallic breathable material securely attached to the frame, the protective screen adapted to resist hail striking the screen and wherein at least a portion of the protective screen is looped over the frame and fastened to another portion of the protective screen;

(b) an attachment means configured to attach the frame of the protective panel to an upper housing of the air-conditioning unit on a side of the air-conditioning unit having a condenser grill; and (c) at least one support rod for supporting the protective panel, the rod having two ends, one end attached to the frame of the protective panel and the other end attached to a lower housing of the air-conditioning unit.

2. The apparatus of claim 1, wherein the attachment means includes a bracket assembly for rotationally coupling the frame of the protective screen to the air-conditioning unit.

3. The apparatus of claim 1, wherein the length of the support rod is variably adjustable.

4. The apparatus of claim 1, wherein the non-metallic breathable material of the protective screen is solar screen material.

5. The apparatus of claim 1, wherein the protective screen includes a layer of solar screen material.

6. The apparatus of claim 1, wherein in the protective screen has an opening and forms a cavity, shaped substantially like a pillow case, and is configured to accept the frame of the protective panel within the cavity of the protective screen.

7. The apparatus of claim 1, wherein the protective panel, attachment means, and support rod are configured such that the plane of the protective panel forms a 45-degree angle relative to a vertical plane formed by the side of the air-conditioning unit.

8. An apparatus for protecting an exposed air-conditioning unit comprising:

(a) at least two protective panels, each having a frame and a protective screen made of non-metallic breathable material securely attached to the frame, the protective screen adapted to resist hail striking the screen and wherein at least a portion of the protective screen is looped over the frame and fastened to another portion of the protective screen;

(b) one first bracket assembly attached to each of the protective panels for rotationally coupling the frame of each protective panel to an upper housing of the air-conditioning unit on a side of the air-conditioning unit having a condenser grill;

(c) one support rod supporting each of the protective panels, each support rod having two ends, one end attached to the frame of the protective panel and the other end attached to a lower housing of the air-conditioning unit;

(d) two second bracket assemblies, one attached to the frame of each of the protective panels for coupling the frame to the support rods; and (e) two third bracket assemblies, one attached to each of the support rods for coupling each support rod with a lower housing of the air-conditioning unit.

9. The apparatus of claim 8, wherein the length of the support rods may be variably adjusted.

10. The apparatus of claim 8, wherein each protective panel is supported by two support rods.

11. The apparatus of claim 8, wherein in the protective screen has an opening and forms a cavity, shaped substantially like a pillow case, and is configured to accept the frame of the protective panel within the cavity of the protective screen.

12. The apparatus of claim 11, wherein the protective screen includes a flap at its opening, the flap and the protective screen are configured to be releasably secured.

13. The apparatus of claim 8, wherein the non-metallic breathable material of the protective screen is solar screen material.

14. An apparatus for protecting an exposed air-conditioning unit comprising:

(a) first and second protective panels, each having a frame and a protective screen made of non-metallic breathable material secured to the frame, the protective screen adapted to resist hail striking the screen;

(b) two first bracket assemblies attached to each of the protective panels for rotationally coupling the frame of each protective panel to an upper housing of the air-conditioning unit on a side of the air-conditioning unit having a condenser grill;

(c) two support rods supporting each of the protective panels, each support rod having two ends, one end attached to the frame of the protective panel and the other end attached to a lower housing of the air-conditioning unit;

(d) four second bracket assemblies, two attached to the frame of each of the protective panels for coupling the frame to the support rods;

(e) four third bracket assemblies, one attached to each of the support rods for coupling each support rod with a lower housing of the air-conditioning unit;

(f) a triangular protective panel having a substantially triangle-shaped frame and a substantially triangle-shaped protective screen made of non-metallic breathable material secured to the triangle-shaped frame, the triangle-shaped protective screen adapted to resist hail striking the screen; and (g) a means for securing the triangular protective panel to the protective panels.

15. The apparatus of claim 14, wherein the means for securing the triangular protective panel to the protective panels is a tie wrap.

16. The apparatus of claim 14, wherein in the height of the support rods are variably adjustable.

17. The apparatus of claim 14, wherein in the protective screen has an opening and forms a cavity, shaped substantially like a pillow case, and is configured to accept the frame of the protective panel within the cavity of the protective screen.

18. The apparatus of claim 17, wherein the protective screen includes a flap at its opening, the flap and the protective screen are configured to be releasably secured.

19. The apparatus of claim 14, wherein the non-metallic breathable material of the protective screen and triangle-shaped protective screen is solar screen material.

20. The apparatus of claim 14, wherein the protective screen and triangle-shaped protective screen include a layer of solar screen material.

* * * * *